US011315728B2

(12) United States Patent
Yang et al.

(10) Patent No.: US 11,315,728 B2
(45) Date of Patent: *Apr. 26, 2022

(54) METHOD OF INCREASING THE COERCIVITY OF A SINTERED ND—FE—B PERMANENT MAGNET

(71) Applicant: Yantai Shougang Magnetic Materials, Inc., Yantai (CN)

(72) Inventors: Kunkun Yang, Yantai (CN); Zhongjie Peng, Yantai (CN); Chuanshen Wang, Yantai (CN)

(73) Assignee: YANTAI SHOUGANG MAGNETIC MATERIALS INC., Yantai (CN)

( * ) Notice: Subject to any disclaimer, the term of this patent is extended or adjusted under 35 U.S.C. 154(b) by 259 days.

This patent is subject to a terminal disclaimer.

(21) Appl. No.: 16/518,272

(22) Filed: Jul. 22, 2019

(65) Prior Publication Data

US 2020/0027657 A1 Jan. 23, 2020

(30) Foreign Application Priority Data

Jul. 20, 2018 (CN) ..... 201810800414.0

(51) Int. Cl.

| | |
|---|---|
| ***H01F 1/055*** | (2006.01) |
| ***H01F 41/02*** | (2006.01) |
| ***C22C 38/00*** | (2006.01) |
| ***C23C 10/30*** | (2006.01) |
| ***H01F 1/057*** | (2006.01) |

(52) U.S. Cl.

CPC ..... *H01F 41/0293* (2013.01); *C22C 38/005* (2013.01); *C23C 10/30* (2013.01); *H01F 1/0577* (2013.01); *H01F 41/0266* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 2009/0252865 | A1* | 10/2009 | Sagawa | H01F 41/005 427/127 |
| 2010/0282371 | A1* | 11/2010 | Sagawa | H01F 41/005 148/302 |
| 2019/0214192 | A1* | 7/2019 | Kuniyoshi | C22C 38/00 |
| 2020/0027655 | A1* | 1/2020 | Wang | H01F 1/0577 |

* cited by examiner

*Primary Examiner* — Xiaowei Su

(74) *Attorney, Agent, or Firm* — William H. Honaker; Dickinson Wright PLLC

(57) ABSTRACT

A method of increasing coercivity of a sintered Nd—Fe—B permanent magnet includes a first step of providing a sintered Nd—Fe—B magnet block having a pair of block surfaces extending perpendicular to a magnetization direction. The method then proceeds with depositing an organic adhesive layer on one of the block surfaces. Next, the method proceeds with depositing a powder containing at least one heavy rare earth element on the organic adhesive layer. After depositing the powder, the sintered Nd—Fe—B magnet block is pressed to adhere the powder to the organic adhesive layer. Then, the method follows with a step of removing excess powder from the sintered Nd—Fe—B magnet block to form a uniform film. Then, the powder is diffused into the sintered Nd—Fe—B magnet is diffused into the sintered Nd—Fe—B magnet block to produce a diffused magnet block. Next, the method proceeds with aging the diffused magnet block.

19 Claims, 2 Drawing Sheets

METHOD OF INCREASING THE COERCIVITY OF A SINTERED ND—FE—B PERMANENT MAGNET

CROSS REFERENCE TO RELATED APPLICATION

This application claims priority to Chinese Application Serial Number CN201810800414.0 filed on Jul. 20, 2018, the entire disclosure of which is incorporated herein by reference in its entirety.

BACKGROUND OF THE INVENTION

1. Field of the Invention

The present invention generally relates to a method of increasing coercivity of a sintered Nd—Fe—B permanent magnet.

2. Description of the Prior Art

Since its invention in 1983, sintered Nd—Fe—B permanent magnets are widely used in a variety of technologies including, but not limited to, computers, automobiles, medical instructions, wind power generators, and other industries. With the development of high speed wind power generators and new energy vehicles, the sintered Nd—Fe—B permanent magnets are required to not demagnetize under high temperature and high speed conditions. Accordingly, this requires an increase in the coercivity of the sintered Nd—Fe—B permanent magnets.

In the sintered Nd—Fe—B permanent magnets, introducing of heavy rare earth elements such as Terbium, Dysprosium increase the coercivity of the sintered Nd—Fe—B permanent magnets. However, the traditional methods allow Dy or Tb to be introduced into the main phase crystal grains thereby decreasing remanence of the sintered Nd—Fe—B permanent magnets. In addition, the traditional methods also consume large amounts of heavy rare earth elements.

Typically, a sintered Nd—Fe—B permanent magnet includes an $Nd_2Fe_{14}B$ main phase and an Nd rich grain boundary phase. The crystal magnetic anisotropy of the $Nd_2Fe_{14}B$ phase determines the coercivity of the sintered Nd—Fe—B permanent magnet. The heavy rare earth elements such as Dy or Tb, diffused through a grain boundary phase, can significantly improve the coercivity of the sintered Nd—Fe—B permanent magnet. According to this theory, many techniques have been developed to increase the coercivity of the sintered Nd—Fe—B permanent magnets such as the diffusion of the heavy rare earth elements such as Dy or Tb or an alloy of Tb or Dy through the grain boundary phase. For example, Chinese Patent Application CN101375352A, by Hitachi Metals, teaches a method of increasing the coercivity of the sintered Nd—Fe—B permanent magnets. The method includes depositing layer of heavy rare earth film on the surface of the sintered Nd—Fe—B permanent magnets by vapor deposition, sputtering, or ion plating. Then, the sintered Nd—Fe—B permanent magnets are placed in a vacuum furnace for the diffusion and aging treatments under a high temperatures. However, the high temperature has a negative effect on the sintered Nd—Fe—B permanent magnets. In addition, there is also a low utilization rate of the heavy rare earth elements, e.g. as a target source, thereby resulting an increase in the cost of manufacturing.

Chinese Patent Application CN105845301A discloses a method which a powder, containing heavy rare earth elements selected from Dy, Tb, an alloy of Dy or Tb, or a mixture of Dy or Tb, is pre-mixed with an organic solvent forming a slurry. The slurry is then applied to the surfaces of the sintered Nd—Fe—B permanent magnet. After drying, the sintered Nd—Fe—B permanent magnet is subjected to a diffusion process and an aging process at high temperatures. Such a process have two disadvantages: 1) because the heavy rare earth powder needs to be completely encapsulated by the organic solvent, the organic solvent is used in large quantities and, accordingly, the organic solvent will form a large amount of gas during the drying process and cause environmental pollution; 2) because the organic solvent is volatile, the ratio of the heavy rare earth elements in the slurry changes overtime and, accordingly, this phenomenon causes the total amount of heavy rare earth deposited on the surface of the sintered Nd—Fe—B permanent magnet to change, resulting in inconsistent magnetic properties after diffusion and aging treatments, i.e. the variation in the magnetic properties of the sintered Nd—Fe—B permanent magnet is excessively large.

SUMMARY OF THE INVENTION

The present invention overcomes the deficiencies mentioned above and provides a method of increasing coercivity of a sintered Nd—Fe—B permanent magnet. The present invention also reduces the amount of heavy rare earth usage during the diffusion process while improves the coercivity of the Nd—Fe—B magnet and the utilization of the heavy rare earth elements. The present invention also controls the particle size range of the heavy rare earth powder thereby controlling the heavy rare earth content adhering to the surface of the sintered Nd—Fe—B permanent magnet such that the precision of the heavy rare earth content is higher. The present invention further prevents impurities from being introduced into the sintered Nd—Fe—B permanent magnet.

It is one aspect of the present invention to provide a method of increasing coercivity of a sintered Nd—Fe—B permanent magnet. The method includes a first step of providing a sintered Nd—Fe—B magnet block having a pair of block surfaces, opposite and spaced from one another, extending perpendicular to a magnetization direction. The method then proceeds with a step of depositing an organic adhesive layer on one of the block surfaces of the sintered Nd—Fe—B magnet block. Next, the method includes a step of depositing a powder containing at least one heavy rare earth element on the organic adhesive layer under an inert gas environment. After depositing the powder, the sintered Nd—Fe—B magnet block containing the powder is pressed to adhere the powder to the organic adhesive layer. Then, the method follows with a step of removing excess powder from the sintered Nd—Fe—B magnet block to form a uniform film on the sintered Nd—Fe—B magnet block. Then, the powder is diffused into the sintered Nd—Fe—B magnet block under a vacuum environment or an inert gas environment to produce a diffused magnet block. Next, the method proceeds with a step of aging the diffused magnet block under the vacuum environment or the inert gas environment.

It is another aspect of the present invention to provide a method of increasing coercivity of a sintered Nd—Fe—B permanent magnet. The method includes a first step of providing a sintered Nd—Fe—B magnet block having a pair of block surfaces, opposite and spaced from one another, extending perpendicular to a magnetization direction. The method then proceeds with a step of depositing an organic adhesive layer, has a predetermined thickness of between 3 μm and 30 μm, on one of the block surfaces of the sintered Nd—Fe—B magnet block with the organic adhesive layer being a pressure-sensitive adhesive or a double-sided tape. Next, the method proceeds with a step of depositing a powder containing at least one heavy rare earth element on the organic adhesive layer under an inert gas environment. The least one heavy rare earth element is selected from a group consisting of Tb, Dy, a chemical compound containing Tb or Dy, or an alloy containing Tb or Dy. The powder has a particle size of between 100 mesh and 500 mesh. Then, the method proceeds with a step of pressing the sintered Nd—Fe—B magnet block containing the powder to adhere the powder to the organic adhesive layer. After pressing, excess powder is removed from the sintered Nd—Fe—B magnet block to form a uniform film. The sintered Nd—Fe—B magnet block including the uniform film is then rotated 180° along an axis orthogonal to the magnetization direction exposing another one of the block surfaces of the sintered Nd—Fe—B magnet block. The steps of depositing the organic adhesive layer, depositing the powder, pressing, and removing are repeated to form the uniform film on the another one of the block surfaces of the sintered Nd—Fe—B magnet block. Next, the method proceeds with a step of diffusing the powder into the sintered Nd—Fe—B magnet block under a vacuum environment or an inert gas environment to produce a diffused magnet block. After diffusing, the diffused magnet block is cooled, then, the diffused magnet block is aged under the vacuum environment or the inert gas environment.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
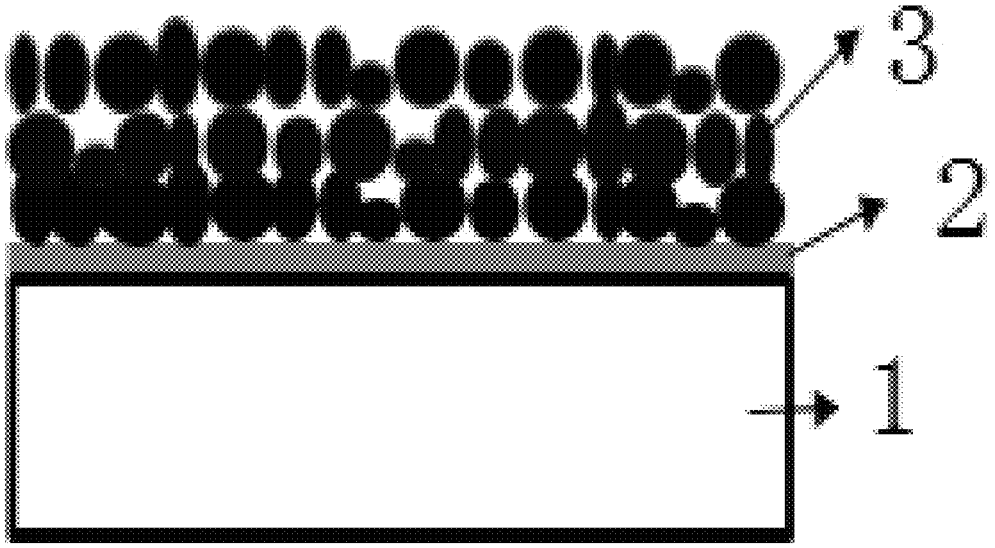
FIG. 1 is a cross-sectional view of a sintered Nd—Fe—B magnet block including an organic adhesive layer and a powder disposed on the organic adhesive layer.
Figure 2:
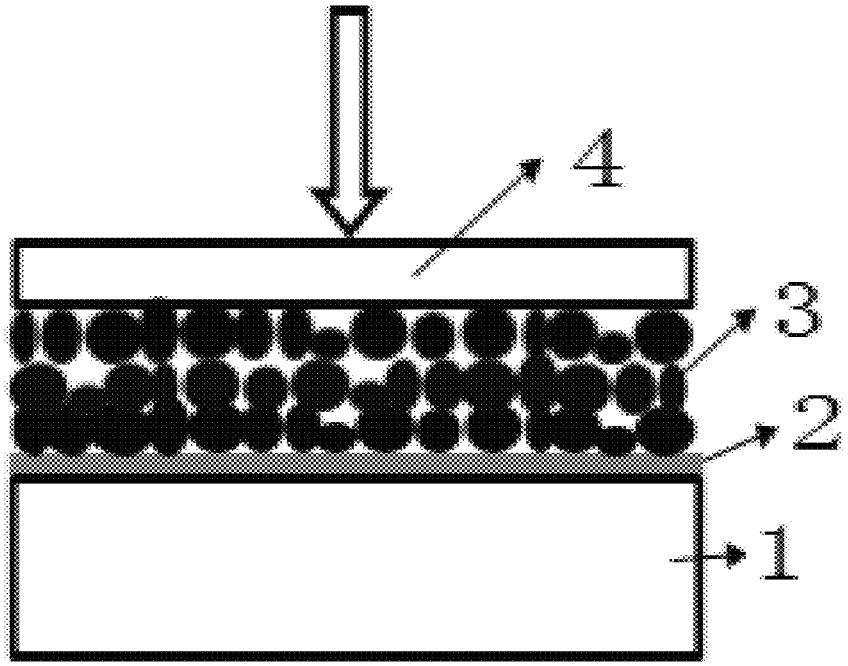
FIG. 2 is a cross-sectional view of a pressing member pressing on the sintered Nd—Fe—B magnet block including the organic adhesive layer and the powder disposed on the organic adhesive layer.
Figure 3:
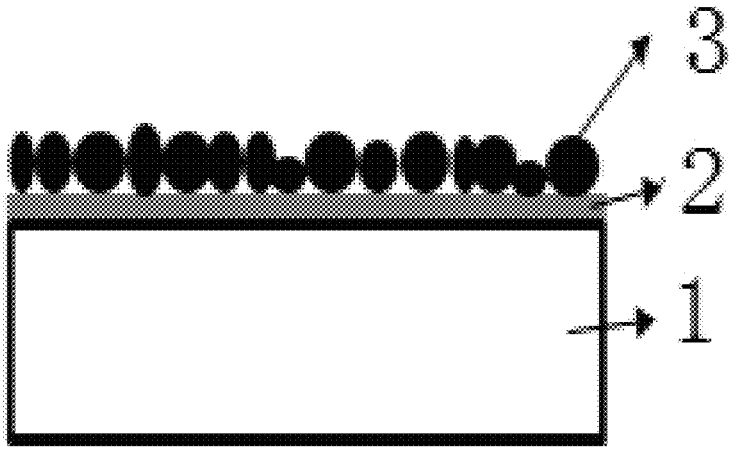
FIG. 3 is a cross-sectional view of the sintered Nd—Fe—B magnet block including a uniform film disposed on one of block surfaces of the Nd—Fe—B magnet block.

Referring to the Figures, wherein like numerals indicate corresponding parts throughout the several views, it is one aspect of the present invention to provide a method of increasing coercivity of a sintered Nd—Fe—B permanent magnet.

The method includes a first step of providing a sintered Nd—Fe—B magnet block 1 having a pair of block surfaces, opposite and spaced from one another, extending perpendicular to a magnetization direction. It should be appreciated that the Nd—Fe—B magnet blocks 1, after sintering, are formed with a preferred magnetization direction. This process can be conducted either by pressing the sintered Nd—Fe—B magnet block 1 in the presence of a magnetic field or undergo a second press that orients the magnetic domains in one direction. In other words, the sintered Nd—Fe—B magnet blocks 1 are magnetized later in the process, long after they are formed. This is because having a single magnetization direction creates a powerful Nd—Fe—B permanent magnet.

Then, the method proceeds with a step of depositing an organic adhesive layer 2 on one of the block surfaces of the sintered Nd—Fe—B magnet block 1. Preferably, the organic adhesive layer 2 has a predetermined thickness between 3 μm and 30 μm. According to one embodiment of the present invention, the organic adhesive layer 2 is a pressure-sensitive adhesive or a double-sided tape. The pressure-sensitive adhesive is selected from a group consisting of an acrylic based pressure-sensitive adhesive, a silicone based pressure-sensitive adhesive, a urethane based pressure-sensitive adhesive, or a rubber based pressure sensitive adhesive. Accordingly, the pressure-sensitive adhesive can be deposited on the one of the block surfaces of the sintered Nd—Fe—B magnet block 1 via a screen printing process. The double-sided tape is selected from a group consisting of a substrate-free double-sided tape, a Polyethylene terephthalate double-sided tape, or a Polyvinyl Chloride double-sided tape. Accordingly, the double-sided tape can be deposited on the one of the block surfaces of the sintered Nd—Fe—B magnet block 1 by a pasting processing.

Next, the method proceeds with a step of depositing a powder 3 containing at least one heavy rare earth element on the organic adhesive layer 2 under an inert gas environment. Preferably, the powder 3 has a particle size of between 100 mesh and 500 mesh. It should be appreciated that the at least one rare earth element of the powder 3 is selected from a group consisting of Tb, Dy, a chemical compound containing Tb or Dy, or an alloy containing Tb or Dy. After depositing the powder 3, the sintered Nd—Fe—B magnet block 1 containing the powder 3 is pressed to adhere the powder 3 to the organic adhesive layer 2 It should be appreciated that, according to one embodiment of the present invention, pressing members 4 can be used to press the powder 3 to adhere the powder 3 to the organic adhesive layer 2. Then, any excess powder is removed from the sintered Nd—Fe—B magnet block 1, via a vacuum apparatus, to form a uniform film on the one of the block surfaces.

According another embodiment of the present invention, the method further includes a step of rotating the sintered Nd—Fe—B magnet block 1 including the uniform film 180° along an axis orthogonal to the magnetization direction exposing another one of the block surfaces of the sintered Nd—Fe—B magnet block 1. Then, the organic adhesive layer 2 is disposed on the another one of the block surfaces of the sintered Nd—Fe—B magnet block 1. Next, the method proceeds with a step of depositing a powder 3 containing at least one heavy rare earth element on the organic adhesive layer 2 under an inert gas environment. After depositing the powder 3, the sintered Nd—Fe—B magnet block 1 containing the powder 3 is pressed to adhere the powder 3 to the organic adhesive layer 2. Then, any excess powder is removed from the sintered Nd—Fe—B magnet block 1 to form a uniform film on the another one of the block surfaces. In other words, the steps of depositing the organic adhesive layer 2, depositing the powder 3, pressing the Nd—Fe—B magnet block 1 including the uniform layer, and removing the excess powder are repeated on the another one of the block surfaces of the Nd—Fe—B magnet block 1 to form the uniform film on the another one of the block surfaces.

Next, the method proceeds with a step of diffusing the powder 3, in a vacuum furnace, into the sintered Nd—

Fe—B magnet block 1 under a vacuum environment or an inert gas environment to produce a diffused magnet block. Preferably, the step of diffusion can be achieved by heating the sintered Nd—Fe—B magnet block containing the powder at a diffusion temperature of between 850° C. and 950° C. for a diffusion duration of between 6 hours to 72 hours. After the step of diffusing, the diffused magnet block is first cooled, the method then proceeds with a step of aging the diffused magnet block under the vacuum environment or the inert gas environment. Preferably, the step of aging can be performed by heating as the diffused magnet block under an aging temperature of between 450° C. and 650° C. for an aging duration of between 3 hours and 15 hour.

Typically, during the diffusion process, a powder containing at least one heavy rare earth element is first mixed with an organic solvent to form a slurry. Then, the slurry is applied to the surfaces of the sintered Nd—Fe—B magnet block. However, because the powder containing the heavy rare earth elements needs to be completely encapsulated by the organic solvent, the organic solvent is used in large quantities. Accordingly, with the organic solvent being volatile, during the drying and diffusion processes, the organic solvent will evaporate and form a large quantity of gases causing heavy environmental pollution. Moreover, because of the volatile nature of the organic solvent, the ratio of the heavy rare earth elements in the slurry changes overtime and, accordingly, this phenomenon causes the total amount of heavy rare earth deposited on the surface of the sintered Nd—Fe—B permanent magnet to change, resulting in inconsistent magnetic properties after diffusion and aging treatments, i.e. the variation in the magnetic properties of the sintered Nd—Fe—B permanent magnet is excessively large. Further, through the diffusion process, the organic solvent along with other impurities can be introduced in to the sintered Nd—Fe—B magnet block and the heavy rare earth content can be difficult to control which have a large negative impact on the production quality.

For the present invention, the particle size of the powder containing the heavy rare earth elements, i.e. between 100 mesh and 500 mesh, and the amount of the powder being disposed on the sintered Nd—Fe—B magnet block are carefully controlled. In other words, the present invention allows the user to control the amount of the heavy rare earth elements that are being used during the diffusion process thereby improving the utilization rate of the heavy rare earth elements. In addition, the present invention only deposits the organic adhesive layer on two of the surfaces of the sintered Nd—Fe—B magnet block, i.e. the pair of surfaces that extend parallel to the magnetization direction. Accordingly, the amount of organic solvent being used is significant reduced thereby reducing amount of pollution during the diffusion process. Further, because the amount of organic solvent is being reduced, this also prevents the amount of impurities from being introduced into the sintered Nd—Fe—B magnet block during the diffusion process.

The examples below provide a better illustration of the present invention. The examples are used for illustrative purposes only and do not limit the scope of the present invention.

Implementing Example 1

For Implementing Example 1, a sintered Nd—Fe—B magnet block, having a dimension of 20 mm*20 mm*1 mm(T) is provided. The sintered Nd—Fe—B magnet block has a pair of block surfaces, opposite and spaced from one another, extending perpendicular to a magnetization direction. An organic adhesive layer of an Acrylic pressure-sensitive adhesive, having a predetermined thickness of 3 μm, is deposited on one of the block surfaces of the sintered Nd—Fe—B magnet block.

Next, a powder containing at least one heavy rare earth element of Tb, having a particle size of 500 mesh, is disposed on the organic adhesive layer under an inert gas environment. After depositing the powder, the sintered Nd—Fe—B magnet block containing the powder is pressed, via a pressing member, to adhere the powder to the organic adhesive layer. Then, any excess powder is removed from the sintered Nd—Fe—B magnet block, via a vacuum apparatus, to form a uniform film on the one of the block surfaces.

Then, the sintered Nd—Fe—B magnet block including the uniform film is rotated 180° along an axis orthogonal to the magnetization direction exposing another one of the block surfaces of the sintered Nd—Fe—B magnet block. Then, the organic adhesive layer of the Acrylic pressure-sensitive adhesive, having the predetermined thickness of 3 μm, is deposited on the another one of the block surfaces of the sintered Nd—Fe—B magnet block. Next, the method proceeds with a step of depositing the powder containing at least one heavy rare earth element of Tb, having a particle size of 500 mesh, on the organic adhesive layer under the inert gas environment. After depositing the powder, the sintered Nd—Fe—B magnet block containing the powder is pressed to adhere the powder to the organic adhesive layer. Then, any excess powder is removed from the sintered Nd—Fe—B magnet block to form a uniform film on the another one of the block surfaces.

Next, the sintered Nd—Fe—B magnet block is heated, in a vacuum furnace and under a vacuum environment or an inert gas environment, at a diffusion temperature of 900° C. for a diffusion duration of 6 hours to form a diffused magnet block. Then, the diffused magnet block is cooled. Then, the diffused magnet block is subjected to an aging treatment by heating the diffused magnet block under an aging temperature of 500° C. for an aging duration of 3 hours. The properties of the sintered Nd—Fe—B permanent magnet produced in Implementing Example 1 ("Implementing Example 1") in comparison with the sintered Nd—Fe—B permanent magnet produced without the diffusion process of Implementing Example 1 ("Original") are set forth below in Table 1.

TABLE 1

Magnetic Properties of the Sintered Nd—Fe—B Permanent Magnet Produced in Implementing Example 1 in Comparison with the Sintered Nd—Fe—B Permanent Magnet Produced Without the Diffusion Process of Implementing Example 1

| | Br (KGs) | $H_{cj}$ (KOe) | $H_k/H_{cj}$ |
|---|---|---|---|
| Original | 14.10 | 16.78 | 0.98 |
| Implementing Example 1 | 13.90 | 26.85 | 0.98 |

As illustrated in Table 1 above, after the diffusion process of Implementing Example 1, the remanence (Br) of the original is lowered by 0.2 KGs, the coercivity (Hc) is increased by 10.07 KOe, and the squareness (WHO has no change.

Implementing Example 2

For Implementing Example 2, a sintered Nd—Fe—B magnet block, having a dimension of 20 mm*20 mm*4 mm(T) is provided. The sintered Nd—Fe—B magnet block has a pair of block surfaces, opposite and spaced from one another, extending perpendicular to a magnetization direction. An organic adhesive layer of a Polyethylene terephthalate double-sided tape, having a predetermined thickness of 5 μm, is deposited on one of the block surfaces of the sintered Nd—Fe—B magnet block.

Next, a powder containing at least one heavy rare earth element of Tb, having a particle size of 200 mesh, is disposed on the organic adhesive layer under an inert gas environment. After depositing the powder, the sintered Nd—Fe—B magnet block containing the powder is pressed, via a pressing member, to adhere the powder to the organic adhesive layer. Then, any excess powder is removed from the sintered Nd—Fe—B magnet block, via a vacuum apparatus, to form a uniform film on the one of the block surfaces.

Then, the sintered Nd—Fe—B magnet block including the uniform film is rotated 180° along an axis orthogonal to the magnetization direction exposing another one of the block surfaces of the sintered Nd—Fe—B magnet block. Then, the organic adhesive layer of the Polyethylene terephthalate double-sided tape, having the predetermined thickness of 5 μm, is deposited on the another one of the block surfaces of the sintered Nd—Fe—B magnet block. Next, the method proceeds with a step of depositing the powder containing the at least one heavy rare earth element of Tb, having a particle size of 200 mesh, on the organic adhesive layer under the inert gas environment. After depositing the powder, the sintered Nd—Fe—B magnet block containing the powder is pressed to adhere the powder to the organic adhesive layer. Then, any excess powder is removed from the sintered Nd—Fe—B magnet block to form a uniform film on the another one of the block surfaces.

Next, the sintered Nd—Fe—B magnet block is heated, in a vacuum furnace and under a vacuum environment or an inert gas environment, at a diffusion temperature of 850° C. for a diffusion duration of 72 hours to form a diffused magnet block. Then, the diffused magnet block is cooled. Then, the diffused magnet block is subjected to an aging treatment by heating the diffused magnet block under an aging temperature of 450° C. for an aging duration of 6 hours. The properties of the sintered Nd—Fe—B permanent magnet produced in Implementing Example 2 ("Implementing Example 2") in comparison with the sintered Nd—Fe—B permanent magnet produced without the diffusion process of Implementing Example 2 ("Original") are set forth below in Table 2.

TABLE 2

Magnetic Properties of the Sintered Nd—Fe—B Permanent Magnet Produced in Implementing Example 2 in Comparison with the Sintered Nd—Fe—B Permanent Magnet Produced Without the Diffusion Process of Implementing Example 2

| | Br (KGs) | $H_{cj}$ (KOe) | $H_k/H_{cj}$ |
|---|---|---|---|
| Original | 14.10 | 16.78 | 0.98 |
| Implementing Example 2 | 14.00 | 26.50 | 0.97 |

As illustrated in Table 2 above, after the diffusion process of Implementing Example 2, the remanence (Br) of the original is lowered by 0.1 KGs, the coercivity (Hc) is increased by 9.72 KOe, and the squareness (WHO has a minimal change.

Implementing Example 3

For Implementing Example 3, a sintered Nd—Fe—B magnet block, having a dimension of 20 mm*20 mm*6 mm(T) is provided. The sintered Nd—Fe—B magnet block has a pair of block surfaces, opposite and spaced from one another, extending perpendicular to a magnetization direction. An organic adhesive layer of a Polyurethane double-sided tape, having a predetermined thickness of 10 μm, is deposited on one of the block surfaces of the sintered Nd—Fe—B magnet block.

Next, a powder containing at least one heavy rare earth element of Dy, having a particle size of 150 mesh, is disposed on the organic adhesive layer under an inert gas environment. After depositing the powder, the sintered Nd—Fe—B magnet block containing the powder is pressed, via a pressing member, to adhere the powder to the organic adhesive layer. Then, any excess powder is removed from the sintered Nd—Fe—B magnet block, via a vacuum apparatus, to form a uniform film on the one of the block surfaces.

Then, the sintered Nd—Fe—B magnet block including the uniform film is rotated 180° along an axis orthogonal to the magnetization direction exposing another one of the block surfaces of the sintered Nd—Fe—B magnet block. Then, the organic adhesive layer of the Polyurethane double-sided tape, having the predetermined thickness of 10 μm, is deposited on the another one of the block surfaces of the sintered Nd—Fe—B magnet block. Next, the method proceeds with a step of depositing the powder containing the at least one heavy rare earth element of Dy, having a particle size of 150 mesh, on the organic adhesive layer under the inert gas environment. After depositing the powder, the sintered Nd—Fe—B magnet block containing the powder is pressed to adhere the powder to the organic adhesive layer. Then, any excess powder is removed from the sintered Nd—Fe—B magnet block to form a uniform film on the another one of the block surfaces.

Next, the sintered Nd—Fe—B magnet block is heated, in a vacuum furnace and under a vacuum environment or an inert gas environment, at a diffusion temperature of 950° C. for a diffusion duration of 12 hours to form a diffused magnet block. Then, the diffused magnet block is cooled. Then, the diffused magnet block is subjected to an aging treatment by heating the diffused magnet block under an aging temperature of 550° C. for an aging duration of 9 hours. The properties of the sintered Nd—Fe—B permanent magnet produced in Implementing Example 3 ("Implementing Example 3") in comparison with the sintered Nd—Fe—B permanent magnet produced without the diffusion process of Implementing Example 3 ("Original") are set forth below in Table 3.

TABLE 3

Magnetic Properties of the Sintered Nd—Fe—B Permanent Magnet Produced in Implementing Example 3 in Comparison with the Sintered Nd—Fe—B Permanent Magnet Produced Without the Diffusion Process of Implementing Example 3

| | Br (KGs) | $H_{cj}$ (KOe) | $H_k/H_{cj}$ |
|---|---|---|---|
| Original | 14.20 | 15.10 | 0.98 |
| Implementing Example 3 | 14.00 | 21.80 | 0.97 |

As illustrated in Table 3 above, after the diffusion process of Implementing Example 3, the remanence (Br) of the original is lowered by 0.2 KGs, the coercivity (Hc) is increased by 6.7 KOe, and the squareness ($H_k/H_{cj}$) has a minimal change.

Implementing Example 4

For Implementing Example 4, a sintered Nd—Fe—B magnet block, having a dimension of 20 mm*20 mm*10 mm(T) is provided. The sintered Nd—Fe—B magnet block has a pair of block surfaces, opposite and spaced from one another, extending perpendicular to a magnetization direction. An organic adhesive layer of a silicon based double-sided tape, having a predetermined thickness of 30 μm, is deposited on one of the block surfaces of the sintered Nd—Fe—B magnet block.

Next, a powder containing at least one heavy rare earth element of Dysprosium Hydride, having a particle size of 100 mesh, is disposed on the organic adhesive layer under an inert gas environment. After depositing the powder, the sintered Nd—Fe—B magnet block containing the powder is pressed, via a pressing member, to adhere the powder to the organic adhesive layer. Then, any excess powder is removed from the sintered Nd—Fe—B magnet block, via a vacuum apparatus, to form a uniform film on the one of the block surfaces.

Then, the sintered Nd—Fe—B magnet block including the uniform film is rotated 180° along an axis orthogonal to the magnetization direction exposing another one of the block surfaces of the sintered Nd—Fe—B magnet block. Then, the organic adhesive layer of the silicon based double-sided tape, having the predetermined thickness of 30 μm, is deposited on the another one of the block surfaces of the sintered Nd—Fe—B magnet block.

Next, the method proceeds with a step of depositing the powder containing the at least one heavy rare earth element of Dysprosium Hydride, having a particle size of 100 mesh, on the organic adhesive layer under the inert gas environment. After depositing the powder, the sintered Nd—Fe—B magnet block containing the powder is pressed to adhere the powder to the organic adhesive layer. Then, any excess powder is removed from the sintered Nd—Fe—B magnet block to form a uniform film on the another one of the block surfaces.

Next, the sintered Nd—Fe—B magnet block is heated, in a vacuum furnace and under a vacuum environment or an inert gas environment, at a diffusion temperature of 950° C. for a diffusion duration of 24 hours to form a diffused magnet block. Then, the diffused magnet block is cooled. Then, the diffused magnet block is subjected to an aging treatment by heating the diffused magnet block under an aging temperature of 600° C. for an aging duration of 15 hours. The properties of the sintered Nd—Fe—B permanent magnet produced in Implementing Example 4 ("Implementing Example 4") in comparison with the sintered Nd—Fe—B permanent magnet produced without the diffusion process of Implementing Example 4 ("Original") are set forth below in Table 4.

TABLE 4

Magnetic Properties of the Sintered Nd—Fe—B Permanent Magnet Produced in Implementing Example 4 in Comparison with the Sintered Nd—Fe—B Permanent Magnet Produced Without the Diffusion Process of Implementing Example 4

| | Br (KGs) | $H_{cj}$ (KOe) | $H_k/H_{cj}$ |
|---|---|---|---|
| Original | 14.20 | 15.10 | 0.98 |
| Implementing Example 3 | 14.10 | 21.30 | 0.97 |

As illustrated in Table 4 above, after the diffusion process of Implementing Example 4, the remanence (Br) of the original is lowered by 0.1 KGs, the coercivity (Hc) is increased by 6.2 KOe, and the squareness ($H_k/H_{cj}$) has a minimal change.

Implementing Example 5

For Implementing Example 5, a sintered Nd—Fe—B magnet block, having a dimension of 20 mm*20 mm*8 mm(T) is provided. The sintered Nd—Fe—B magnet block has a pair of block surfaces, opposite and spaced from one another, extending perpendicular to a magnetization direction. An organic adhesive layer of a Polyurethane pressure-sensitive adhesive, having a predetermined thickness of 30 μm, is screen printed on one of the block surfaces of the sintered Nd—Fe—B magnet block.

Next, a powder containing at least one heavy rare earth element of Terbium-Copper Alloy Powder (containing 85 wt. % of Tb), having a particle size of 100 mesh, is disposed on the organic adhesive layer under an inert gas environment. After depositing the powder, the sintered Nd—Fe—B magnet block containing the powder is pressed, via a pressing member, to adhere the powder to the organic adhesive layer. Then, any excess powder is removed from the sintered Nd—Fe—B magnet block, via a vacuum apparatus, to form a uniform film on the one of the block surfaces.

Then, the sintered Nd—Fe—B magnet block including the uniform film is rotated 180° along an axis orthogonal to the magnetization direction exposing another one of the block surfaces of the sintered Nd—Fe—B magnet block. Then, the organic adhesive layer of the Polyurethane pressure-sensitive adhesive, having the predetermined thickness of 30 μm, is deposited on the another one of the block surfaces of the sintered Nd—Fe—B magnet block. Next, the method proceeds with a step of depositing the powder containing the at least one heavy rare earth element of Terbium-Copper Alloy Powder (containing 85 wt. % of Tb), having the particle size of 100 mesh, on the organic adhesive layer under the inert gas environment. After depositing the powder, the sintered Nd—Fe—B magnet block containing the powder is pressed to adhere the powder to the organic adhesive layer. Then, any excess powder is removed from the sintered Nd—Fe—B magnet block to form a uniform film on the another one of the block surfaces.

Next, the sintered Nd—Fe—B magnet block is heated, in a vacuum furnace and under a vacuum environment or an inert gas environment, at a diffusion temperature of 900° C. for a diffusion duration of 36 hours to form a diffused magnet block. Then, the diffused magnet block is cooled. Then, the diffused magnet block is subjected to an aging treatment by heating the diffused magnet block under an aging temperature of 650° C. for an aging duration of 10 hours. The properties of the sintered Nd—Fe—B permanent magnet produced in Implementing Example 5 ("Implementing Example 5") in comparison with the sintered Nd—Fe—B permanent magnet produced without the diffusion process of Implementing Example 5 ("Original") are set forth below in Table 5.

TABLE 5

Magnetic Properties of the Sintered Nd—Fe—B Permanent Magnet Produced in Implementing Example 5 in Comparison with the Sintered Nd—Fe—B Permanent Magnet Produced Without the Diffusion Process of Implementing Example 5

| | Br (KGs) | $H_{cj}$ (KOe) | $H_k/H_{cj}$ |
|---|---|---|---|
| Original | 14.20 | 15.10 | 0.98 |
| Implementing Example 3 | 14.10 | 24.50 | 0.97 |

As illustrated in Table 5 above, after the diffusion process of Implementing Example 5, the remanence (Br) of the original is lowered by 0.1 KGs, the coercivity (Hc) is increased by 9.4 KOe, and the squareness ($H_k/H_{cj}$) has a minimal change.

As illustrated by the implementing examples, using an organic adhesive adhering a powder on the surfaces of the sintered Nd—Fe—B magnet block and subjecting the sintered Nd—Fe—B magnet block to a diffusion process, can significantly increase the coercivity of the sintered Nd—Fe—B magnet block with without reducing the remanence.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims.

What is claimed is:

1. A method of increasing coercivity of a sintered Nd-Fe-B permanent magnet, the method including the steps of:

a) providing a sintered Nd-Fe-B magnet block having a pair of block surfaces, opposite and spaced from one another, extending perpendicular to a magnetization direction;

b) depositing an organic adhesive layer, selected from one of a pressure-sensitive adhesive or a double-sided tape on one of the block surfaces of the sintered Nd-Fe-B magnet block;

c) depositing a powder containing at least one heavy rare earth element on the organic adhesive layer under an inert gas environment;

d) pressing the sintered Nd-Fe-B magnet block containing the powder to adhere the powder to the organic adhesive layer;

e) removing excess powder from the sintered Nd-Fe-B magnet block to form a film on the sintered Nd-Fe-B magnet block;

f) diffusing the powder into the sintered Nd-Fe-B magnet block under a vacuum environment or an inert gas environment to produce a diffused magnet block;

g) aging the diffused magnet block under the vacuum environment or the inert gas environment.

2. The method as set forth in claim 1 wherein the organic adhesive layer has a predetermined thickness of between 3 μm and 30 μm.

3. The method as set forth in claim 1 wherein the organic adhesive layer is a pressure-sensitive adhesive or a double-sided tape.

4. The method as set forth in claim 3 wherein said step of depositing an organic adhesive layer is further defined as screen printing the pressure-sensitive adhesive on the one of the block surfaces.

5. The method as set forth in claim 3 wherein said step of depositing is further defined as pasting the double-sided tape on the one of the block surfaces.

6. The method as set forth in claim 3 wherein the pressure-sensitive adhesive is one selected from the group consisting of an acrylic based pressure-sensitive adhesive, a silicon based pressure-sensitive adhesive, a urethane based pressure-sensitive adhesive, and a rubber based pressure sensitive adhesive.

7. The method as set forth in claim 3 wherein the double-sided tape is one selected from the group consisting of a substrate-free double-sided tape, a Polyethylene terephthalate double-sided tape, and a Polyvinyl Chloride double-sided tape.

8. The method as set forth in claim 1 wherein the at least one heavy rare earth element is one selected from the group consisting of Tb, Dy, a chemical compound containing Tb or Dy, and an alloy containing Tb or Dy.

9. The method as set forth in claim 1 wherein the powder has a particle size of between 100 mesh and 500 mesh.

10. The method as set forth in claim 1 wherein said step of diffusion is further defined as heating the sintered Nd-Fe-B magnet block containing the powder at a diffusion temperature of between 850° C. and 950° C. for a diffusion duration of between 6 hours to 72 hours.

11. The method as set forth in claim 1 wherein said step of aging is further defined heating as the diffused magnet block under an aging temperature of between 450° C. and 650° C. for an aging duration of between 3 hours and 15 hour.

12. The method as set forth in claim 1 further including the steps of:

rotating the sintered Nd-Fe-B magnet block including the film 180° along an axis orthogonal to the magnetization direction exposing another one of the block surfaces of the Nd-Fe-B magnet block prior to said step of diffusing; and repeating steps b) e) on the another one of the block surfaces of the sintered Nd-Fe-B magnet block.

13. A method of increasing coercivity of a sintered Nd-Fe-B permanent magnet, the method including the steps of:

a) providing a sintered Nd-Fe-B magnet block having a pair of block surfaces, opposite and spaced from one another, extending perpendicular to a magnetization direction;

b) depositing an organic adhesive layer, has a predetermined thickness of between 3 μm and 30 μm, on one of the block surfaces of the sintered Nd-Fe-B magnet block with the organic adhesive layer being a pressure-sensitive adhesive or a double-sided tape;

c) depositing a powder containing at least one heavy rare earth element on the organic adhesive layer under an inert gas environment, the least one heavy rare earth element being one selected from the group consisting of Tb, Dy, a chemical compound containing Tb or Dy, and an alloy containing Tb or Dy, and the powder having a particle size of between 100 mesh and 500 mesh;

d) pressing the sintered Nd-Fe-B magnet block containing the powder to adhere the powder to the organic adhesive layer;

e) removing excess powder from the sintered Nd-Fe-B magnet block to form a film on the Nd-Fe-B magnet block;

f) rotating the sintered Nd-Fe-B magnet block including the film 180° along an axis orthogonal to the magnetization direction exposing another one of the block surfaces of the sintered Nd-Fe-B magnet block;

g) repeating steps b) e) on the another one of the block surfaces of the sintered Nd-Fe-B magnet block h) diffusing the powder into the sintered Nd-Fe-B magnet block under a vacuum environment or an inert gas environment to produce a diffused magnet block;

i) cooling the diffused magnet block;

j) aging the diffused magnet block under the vacuum environment or the inert gas environment.

14. The method as set forth in claim 13 wherein said step of depositing is further defined as screen printing the pressure-sensitive adhesive on the one of the block surfaces.

15. The method as set forth in claim 13 wherein said step of depositing is further defined as pasting the double-sided tape on the one of the block surfaces.

16. The method as set forth in claim 13 wherein the pressure-sensitive adhesive is one selected from the group consisting of an acrylic based pressure-sensitive adhesive, a silicone based pressure-sensitive adhesive, a urethane based pressure-sensitive adhesive, and a rubber based pressure sensitive adhesive.

17. The method as set forth in claim 13 wherein the double-sided tape is one selected from the group consisting of a substrate-free double-sided tape, a Polyethylene terephthalate double-sided tape, and a Polyvinyl Chloride double-sided tape.

18. The method as set forth in claim 13 wherein said step of diffusion is further defined as heating the sintered Nd-Fe-B magnet block containing the powder at a diffusion temperature of between 850° C. and 950° C. for a diffusion duration of between 6 hours to 72 hours.

19. The method as set forth in claim 13 wherein said step of aging is further defined heating as the diffused magnet block under an aging temperature of between 450° C. and 650° C. for an aging duration of between 3 hours and 15 hour.

* * * * *